United States Patent [19]

Lubojatsky et al.

[11] 3,932,998

[45] Jan. 20, 1976

[54] MINE ROOF SUPPORT

[75] Inventors: Walter Lubojatsky, Recklinghausen; Wilhelm Wertelewski, Datteln, both of Germany

[73] Assignee: Becorit Grubenausbau GmbH, Recklinghausen, Germany

[22] Filed: Feb. 15, 1974

[21] Appl. No.: 442,833

[30] Foreign Application Priority Data

Feb. 27, 1973 Germany ..... 2309671

[52] U.S. Cl. ..... 61/45 D

[51] Int. Cl.[2] ..... E21D 23/04

[58] Field of Search ..... 61/45 D, 84, 85; 299/31, 299/33

[56] References Cited

UNITED STATES PATENTS

| | | | |
|---|---|---|---|
| 3,483,705 | 12/1969 | Roberts | 299/11 |

FOREIGN PATENTS OR APPLICATIONS

| | | | |
|---|---|---|---|
| 1,958,322 | 11/1970 | Germany | 61/45 D |
| 250,842 | 1/1970 | U.S.S.R. | 61/45 D |
| 238,488 | 7/1969 | U.S.S.R. | 61/45 D |
| 232,897 | 4/1969 | U.S.S.R. | 61/45 D |

*Primary Examiner*—Jacob Shapiro

[57] ABSTRACT

A mine roof support for use at a mineral face comprises at least one prop, a canopy or roof-engaging structure adapted to lie against the roof of a mine working, a base member adapted to lie on a floor of said mine working, and a shield flexibly connecting, by hinge means, said canopy or roof-engaging structure and said base member. Said hinge means have their axes lying in the longitudinal direction of the mineral face and the hinge means connecting the shield to the base member is constructed so as to provide additionally for movement of the shield laterally relatively to the base member. In one preferred construction the axis of said hinge, which as stated lies in the longitudinal direction of the mineral face, is itself pivotable about an axis lying in the advancing direction of the roof support. The hinge connecting the shield to the canopy or roof-engaging structure may be similarly constructed. The shield may be constructed and arranged so that it will transfer, at least in part, the support forces between the roof and floor.

10 Claims, 3 Drawing Figures

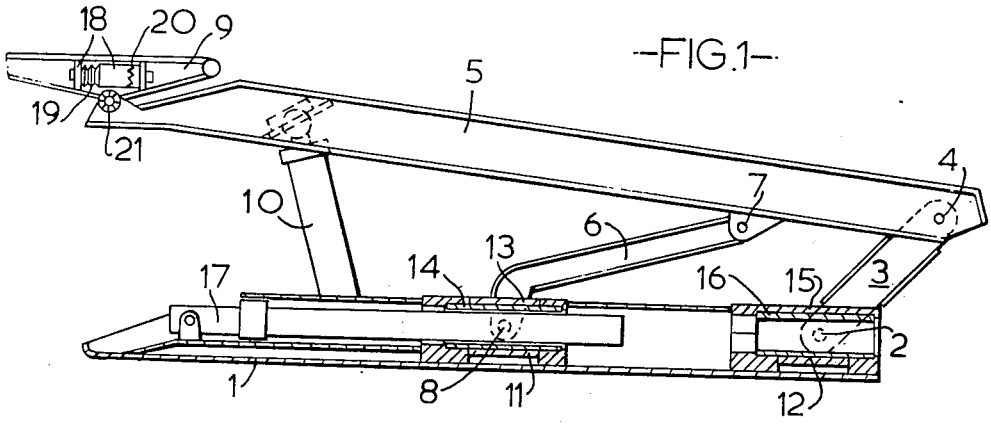
-FIG. 1-
-FIG. 2-
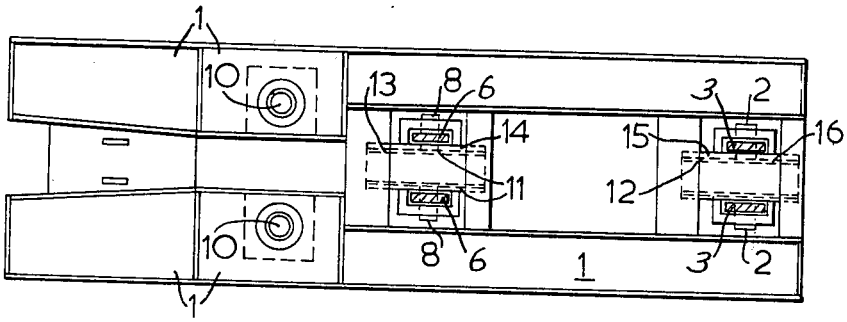
-FIG. 3-
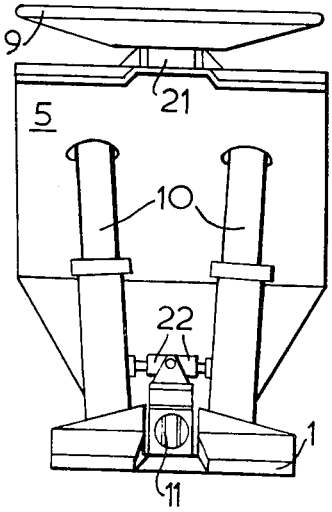

MINE ROOF SUPPORT

BACKGROUND OF THE INVENTION

The invention is concerned with a shield assembly in or for use in a mine roof support and more particularly but not essentially to a shield assembly comprising at least one prop and a canopy adapted to lie against the roof as well as a base plate adapted to lie on the floor which are connected through a hinged shield construction which has one or more hinge axes lying in the longitudinal direction of the face, wherein the shield construction transfers at least in part the support forces between the roof and floor.

A shield assembly of this kind is known for example from the Journal "GLUCKAUF" 103 (1967) pages 1013 to 1017. A particular characteristic of such a shield support assembly is that the support forces of the prop or props or the hinged shield construction are spread out, in scissors fashion, so that the hinges of the shield construction are included in the force flow for development of the support forces. The shield support assembly of the stated art differs basically from those support blocks or advancing roof supports which are provided on the goaf, or rear, side i.e., the side away from the working face, with flushing shield plates or flushing shield boxes, which are not included in the force flow for development of the support forces but serve only the purpose of preventing penetration of the waste into the face space.

In the known shield assemblies of the said kind on so far unexplained grounds deformations and breakages frequently occur in the hinge parts of the shield construction. As a basis for these defects it was at first supposed that the hinges of the shield construction had not been sufficiently stable. As careful research has shown the above-mentioned defects in the hinges of the shield construction are in no way to be traced back to the fact that these hinges were too weakly constructed but could be traced back to the fact that these hinges were unfavourably loaded. In fact these unfavourable loadings result when relative movements between roof and floor in the longitudinal direction of the face occur or when irregularities in the floor or roof are present. With such loadings strong transverse forces arise in the hinge mechanism of the shield construction which distort and damage these hinges.

It is therefore an object of the present invention to improve the shield support assembly in such a way that the overloading phenomena and damages referred to are avoided in the hinges of the shield construction.

SUMMARY

According to the present invention there is provided a mine roof support, for use at a mineral face, comprising at least one prop, a canopy or roof-engaging structure adapted to lie against the roof of a mine working, a base member adapted to lie on a floor of said mine working and a shield flexibly connecting said canopy or roof-engaging structure and said base member by hinge means having their axes lying in the longitudinal direction of the mineral face, the hinge means connecting the shield to the base member providing additionally for movement of the shield laterally relatively to the base member.

Preferably in the roof support described in the preceding paragraph the shield is operative to transfer, at least in part, the support forces between the roof and floor. It is also preferred that the axis of the hinge means connecting the shield to the base member is pivotable about an axis lying in the advancing direction of the roof support.

In the shield assembly frame according to the invention the previously referred to overloading phenomena and damages in the hinges of the shield construction suprisingly no longer arise. In the shield assembly according to the invention relative movements between the roof and floor in the longitudinal direction of the face or irregularities can no longer give rise to unfavourable loading of the shield construction because the foot part and the shield construction can pivot relatively to one another about the hinge axes on the hinge mechanism in such a way that forces produced by adaptation movements can no longer act on the hinges of the shield construction.

According to a preferred embodiment of the invention the canopy is connected with the shield construction through a hinge, so that the hinge axis of the shield construction lying in the advancing direction of the support frame is swingable relative to the canopy. A somewhat similar hinge connection between a canopy and a support element is known from German Offenlegungsschrift No. 2,027,367. A still better adaptability to irregularities in the roof is imparted to the shield assembly according to the invention through use of an additional hinge between the canopy and the shield construction, wherein simultaneously unfavourable loadings produced through such irregularities are kept away from the hinge axes of the shield construction.

Suitably in the shield support frame according to the invention the hinge axis of the hinge mechanism is located seen from the longitudinal direction of the face approximately centrally in the roof support between the shield construction and the base plate. Through this the shield construction can incline on both sides to approximately the same extent relative to the base plate, so that it can be particularly well adapted to these irregularities in the floor.

Preferably the hinge mechanism between the shield construction and the base plate is constructed as a tubular hinge which consists of concentrically arranged tubular sections. Such a hinge consisting of two sections is very robust, cheap to manufacture and can absorb without difficulty strong forces without undergoing deformation or other damage. In particular such a hinge consisting of tubular sections makes possible good use of the space available. In the inner tube section the ram of the support frame can, for example, be particularly suitably housed. It is known from German Auslegeschrift No. 1,804,611 in connection with an advancing roof support to fasten the supports together by a tubular hinge and to arrange a ram in the tubular hinge. This tubular hinge is however not incorporated in the force flow for the development of the support forces and does not therefore serve the purpose of keeping away transverse forces or similar unfavourable loadings on parts of the roof support.

In order, after the movement of the base plate relative to the shield construction, to be able to bring both parts again into the norm position, aligning devices are arranged between the shield construction and the base plate, or parts connected with the base plate. These aligning devices use the base plate or the parts connected with the base plate as abutments and move (after the support element has been released from tension between roof and floor) the shield construction again into its norm position relative to the base plate. The aligning devices are suitably formed as pressure-medium cylinders. These pressure-medium cylinders can be completely balanced so long as the roof support is in tension between the roof and floor so that the movements of the shield construction relative to the base plate are not prevented. For alignment it is sufficient to pressurise briefly these pressure-medium cylinders with pressure-medium during the advancing step of the roof support.

According to another particularly economical embodiment the aligning devices can also be formed as spring elements. Alignment means between the base plate and the props of a roof support formed as spring elements or as pressure-medium cylinders are known from German Auslegeschrift No. 1,816,955. However such aligning means have hitherto not been used with shield support assemblies.

BRIEF DESCRIPTION OF THE DRAWINGS.

One embodiment of the invention by way of example is explained in more detail below with reference to the drawings in which:

FIG. 1 is a section of a shield assembly according to the invention,

FIG. 2 is a plan view of the base plate of a shield assembly according to the invention, and FIG. 3 is a view of a shield assembly according to the invention from the coal face.

DESCRIPTION OF THE PREFERRED EMBODIMENTS.

In the drawing the base plate of the shield assembly is indicated by reference numeral 1. At its rear end a flushing shield 3 is attached to the base plate 1 by means of a hinge 2, and is connected at its upper end to a caving shield 5 through a hinge 4. The caving shield 5 is connected to the base plate 1 also by a guide rod 6 which acts on the caving shield 5 through a hinge 7 and on the base plate 1 through a hinge 8. The hinge axes of the hinges 2, 4, 7 and 8 all lie in the longitudinal direction of the face. The flushing shield 3 and the guide rod 6 together form with the section of the base plate 1, which lies between the hinges 2 and 8, and the section of the caving shield 5, which lies between the hinges 4 and 7, a quadrilateral hinge.

The caving shield 5 supports with its forward end a canopy 9. In addition the caving shield is supported in its longitudinal region by two hydraulic props 10, which are located with their feet in the base plate 1.

In order to give the shield assembly a movement play relatively to the base plate 1, in a vertical plane lying in the longitudinal direction of the face, in the region of the points of application of the flushing shield 3 and the guide rod 6, between the base plate 1 and the shield construction, two hinges 11 and 12 are arranged the common hinge axis of which lies in the advancing direction of the roof support and, seen from the longitudinal direction of the face, is located approximately centrally in the roof support. The hinge parts of the two hinges 11 and 12 are formed as concentrically arranged tubular sections 13 and 14 or 15 and 16, which have a relatively large diameter. The inner diameter of the inner tubular section 14 of the hinge 8 is of such size that a section of a ram 17 of the roof support can be arranged in this tubular section 14 and thereby gives a particularly favourable guidance and all round support.

As can be clearly seen from the drawing the shield assembly on inclination of the base plate 1 in the longitudinal direction of the face or on movements parallel to the stratification in the lontitudinal direction of the face, can readily swivel about the hinges 11 and 12, so that force components directed in the longitudinal direction of the face can no longer stress the shield assembly and in particular its hinge mechanism.

The quandrilateral hinge moves between the caving shield 5 and the base plate 1 on pivoting of the caving shield 5 in such a way that the forward end of the caving shield 5 moves on a lemniscate which has in the pivoting area a very large radius of curvature so that an almost vertical line results for the top of the caving shield. In order to compensate for the small deviation from a vertical straight line, the canopy 9 is connected with the forward end of the caving shield 5 displaceable in the advancing direction of the roof support. In order also to enable the canopy 9 to swivel in a vertical plane lying in the longitudinal direction of the face, the connection between the canopy 9 and caving shield 5 is formed as a pin joint 18, the hinge axis of which lies in the advancing direction of the roof support and in which the canopy 9, in the axial direction of the pin joint, is permitted so large a clearance that the above-mentioned deviation can be avoided. In order to attain a strong hold for the canopy 9 despite the large clearance in the axial direction, plate springs 19 are mounted on the pin joints which tension mutually the hinge parts in the axial direction of the hinge.

In order to give to the canopy 9 further additional holding against undesired swivelling movements on release of the roof support from tensioning, there is provided between the hinge parts a pre-tensioned locking device 20 which consists of two discs pressed against one another in the axial direction and having radially arranged teeth. The holding force of this locking device 20 which is pretensioned in the axial direction by the plate springs 19 is obviously so small that it is easily overcome by the forces arising in the set roof support.

In order to attain, in the longitudinal direction of the face, the requisite movement play between the canopy 9 and the caving shield 5 and to make possible swivelling movement of the canopy about an axis running in the longitudinal direction of the face, a pin joint 21 is additionally arranged under the pin joint 18, which corresponds in all details of its construction to the pin joint 18, the hinge axis of which however lies in the longitudinal direction of the face.

For alignment of the shield construction in the norm position relative to the base plate aligning devices 22 are provided between the props 10, connected with the base plate, and the shield construction (FIG. 3). These aligning devices are formed in the illustrated embodiment as pressure-medium cylinders which are charged with pressure-medium on releasing the roof support from tensioning. In place of such pressure-medium cylinders there can also be used springs, dashpots or other resilient elements.

We claim:

1. A mine roof support comprising an elongated ground-engaging structure for placement with its longitudinal axis perpendicular to a mineral face, a roof-engaging structure overlying a forward portion of the ground-engaging structure, a shield structure extending between the rear of said ground-engaging structure and said roof-engaging structure longitudinally of and overlying said ground-engaging structure, first hinge means having a first hinge axis extending transversely to the longitudinal axis of said ground-engaging structure and serving hingedly to connect a rear portion of said shield structure to said ground-engaging structure, hydraulically extensible prop means extending between said shield structure and said ground-engaging structure and operable to pivot said shield structure relative to said ground-engaging structure about said first hinge means, second hinge means connecting a forward portion of said shield structure to said roof-engaging structure, said first hinge means including pivot means whereby said first hinge axis is pivotal about a second axis normal to said first hinge axis.

2. A mine roof support according to claim 1 wherein said pivot means is arranged to permit pivotal movement of said first hinge axis about an axis extending longitudinally of said ground-engaging structure.

3. A mine roof support according to claim 1, wherein said second hinge means connecting said shield structure and said roof-engaging structure also includes a first hinge axis and pivot means whereby the first hinge axis of said second hinge means is pivotal about a second axis normal to its first hinge axis.

4. A mine roof support according to claim 3 wherein the first hinge axis of said second hinge means also extends transversely of said ground-engaging structure.

5. A mine roof support according to claim 3 wherein said second axis of said first hinge means extends longitudinally and centrally of said ground-engaging structure.

6. A mine roof support according to claim 3 wherein said first hinge means connecting said shield structure to said ground-engaging structure includes two link members spaced apart along the length of said ground-engaging structure, each said link member being pivotally attached at one end to said shield structure and at the opposite end to a tubular hinge means forming said pivot means which is connected to said ground-engaging structure.

7. A mine roof support according to claim 6 wherein said tubular hinge means is constituted by two tubular hinges having their hinge axes in alignment longitudinally and centrally of said ground-engaging structure.

8. A mine roof support according to claim 6 wherein said tubular hinge means is constituted by two tubular hinges having aligned hinge axes, one of siad tubular hinges being displaceable relative to the other longitudinally of said ground-engaging structure by ram means arranged within an inner tubular section of said one tubular hinge.

9. A mine roof support according to claim 3 including aligning means arranged between said shield structure and said ground-engaging structure.

10. A mine roof support according to claim 9 wherein said aligning means are consituted by pressure-medium cylinders.

* * * * *